United States Patent [19]

Koszegi

[11] 3,989,080

[45] Nov. 2, 1976

[54] CARRYING CASE WITH EXPANDABLE COMPARTMENT

[75] Inventor: George Koszegi, South Bend, Ind.

[73] Assignee: Koszegi Leather & Vinyl Products, Inc., South Bend, Ind.

[22] Filed: Apr. 21, 1976

[21] Appl. No.: 679,036

[52] U.S. Cl. ..... 150/1.7; 190/44; 190/52

[51] Int. Cl.[2] ..... A45C 3/04; A45C 7/00

[58] Field of Search ..... 150/28 R, 33, 1.7; 190/51, 52, 43, 44

[56] References Cited

UNITED STATES PATENTS 1,666,704 4/1928 Hunter ..... 150/1.7

3,122,225 2/1964 Ward ..... 190/52

*Primary Examiner*—Donald F. Norton

*Attorney, Agent, or Firm*—Oltsch & Knoblock

[57] ABSTRACT

A carrying case having first and second storage compartments in which the second storage compartment can be collapsed and folded into a stored position against the side wall of the first compartment. A cover or flap anchored to the first compartment of the carrying case is utilized to enclose the folded second compartment when in its stored position.

3 Claims, 7 Drawing Figures

Fig. 1
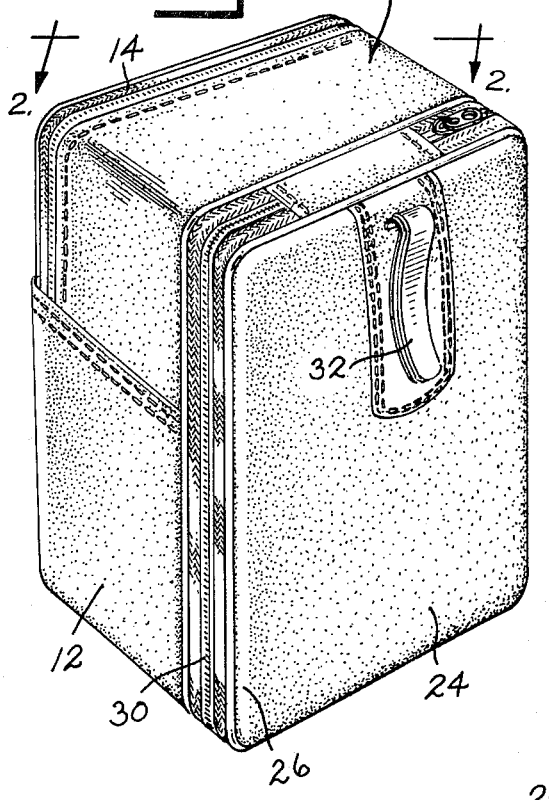
Fig. 2
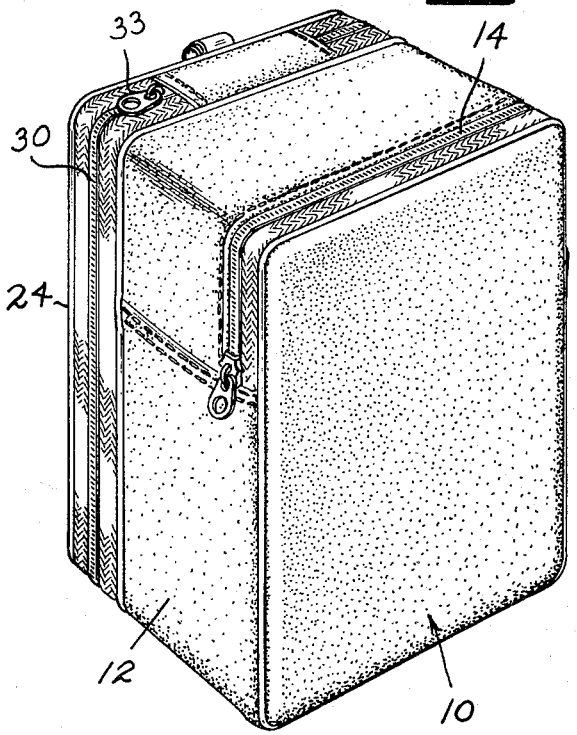
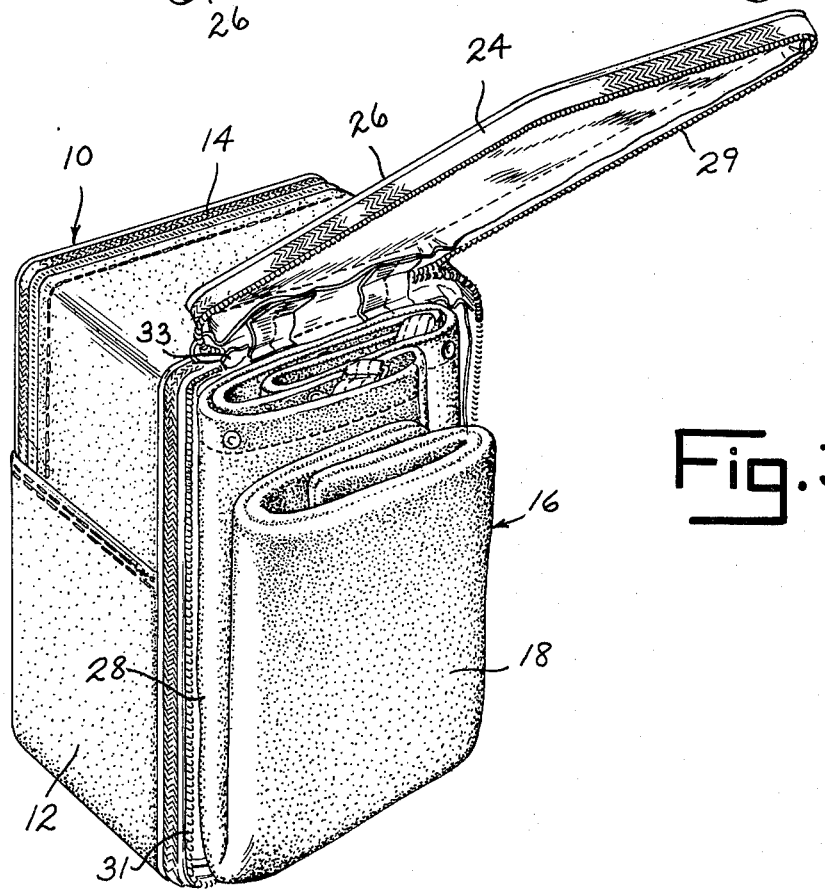
Fig. 3

CARRYING CASE WITH EXPANDABLE COMPARTMENT

BACKGROUND OF THE INVENTION

This invention relates to a carrying case having an expandable compartment.

Carrying cases or bags consisting of multiple compartments in which one or more such compartments may be folded into a stored position have been previously commercially produced. One such bag included two small compartments each having a zipper enclosed access opening and which when placed in a back to back relationship serve to enclose a folded third compartment. This third compartment is sewed to both of the two small compartments which are secured together about their backs by a zipper to enclose the folded third compartment. In a bag of this construction, it is difficult for the user to properly fold the third compartment to enable it to be stored between the zipper connected first two compartments. In the following described invention, the bag or carrying case thereof is constructed so that the collapsible compartment may be easily folded into its stored position.

SUMMARY OF THE INVENTION

The carrying case of this invention includes first and second compartments each defined by a side wall and having an access opening. The second compartment is secured to the first compartment sidewall in such a manner so as to enable the second compartment to be folded against the first compartment sidewall into a stored position. A closure flap is carried by the first compartment and overlies the folded second compartment. A zipper or similar securement means anchors the flap to the sidewall of the first compartment peripherally about the folded second compartment at a location spaced from where the second compartment is secured to the first compartment sidewall.

Accordingly, it is an object of this invention to provide a carrying case having first and second storage compartments with one such compartment being foldable against the other compartment into a collapsed stored position when not in use.

Another object of this invention is to provide a carrying case having multiple compartments of which at least one of the compartments can be easily folded from a usable position to a stored position against the other compartment.

Still another object of this invention is to provide a carrying case which has multiple storage compartments and which is of unique design and versatility.

Other objects of this invention will become apparent by reading the invention's description.

BRIEF DESCRIPTION OF THE DRAWINGS

A preferred embodiment of this invention has been chosen for the purpose of illustration and description wherein:

FIG. 1 is a perspective view of the carrying case as seen from the rear.

FIG. 2 is a front perspective view of the carrying case as viewed from line 2—2 of FIG. 1.

FIG. 3 is a perspective view of the carrying case as seen in FIG. 1 but with a cover flap open to expose a collapsed compartment of the case.

DESCRIPTION OF THE PREFERRED EMBODIMENT

Figure 4:
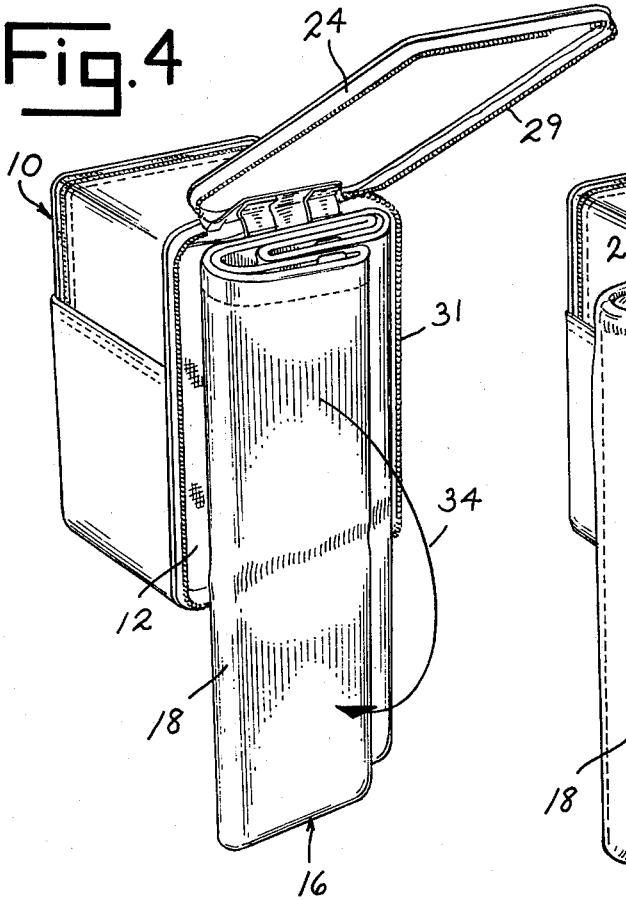
FIG. 4 is a view of the carrying case showing the collapsed compartment thereof being unfolded.

The preferred embodiment illustrated is not intended to be exhaustive or to limit the invention to the precise form disclosed. It is chosen and described in order to best explain the principles of the invention and its application and practical use to thereby enable other skilled in the art to best utilize the invention.

The illustrated carrying case includes a compartment 10 having a sidewall 12. An access opening closed by a zipper 14 is formed in compartment 10.

Also forming a component of the carrying case is a second compartment 16 having a sack-defining sidewall 18 which is open at the top. A shoulder strap 20 is attached to sidewall 18. Compartment 16 is secured to compartment 10 by having a portion 22 of its sidewall 18 adjacent its opening 19 sewed or otherwise attached to sidewall 12 of compartment 10 at a location slightly below upper edge 21 of the compartment.

Figure 5:
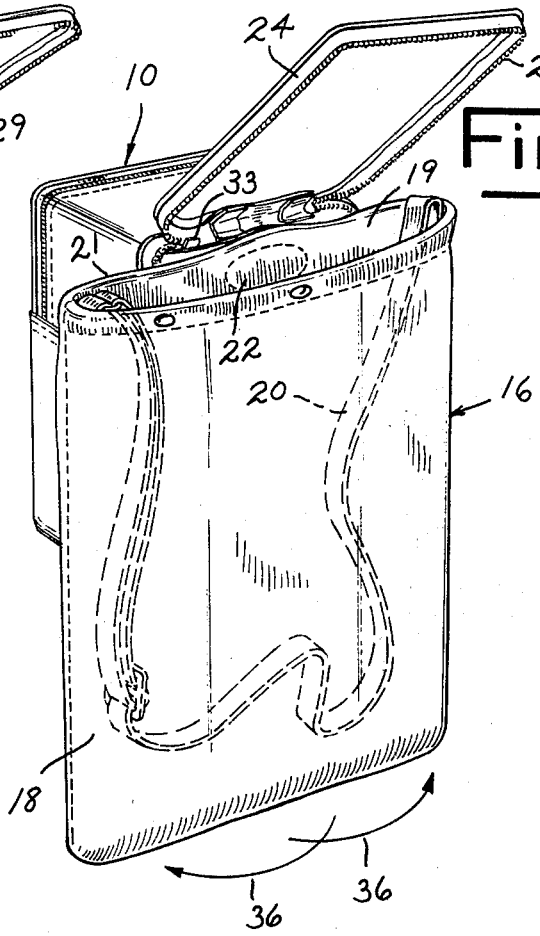
FIG. 5 is a perspective view of the carrying case showing the collapsed compartment thereof completely unfolded.
Figure 6:
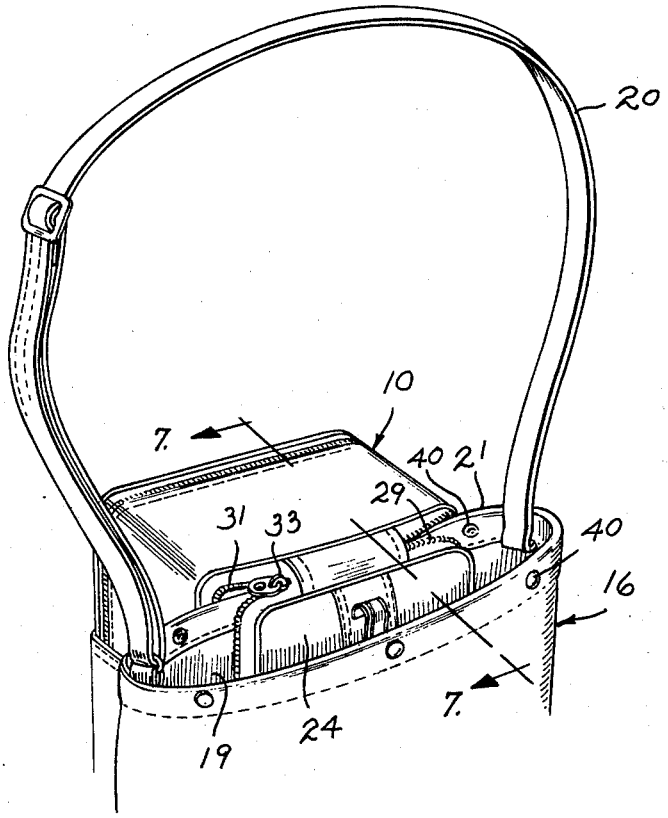
FIG. 6 is a fragmentary perspective view of the carrying case showing the unfolded compartment with its carrying strap in extended form and with the closure flap inserted into the access opening of the compartment.

A flap 24 is connected to sidewall 12 of compartment 10 at its upper edge 21. Sidewall 18 of compartment 16 is adapted to be flattened as illustrated in FIG. 5 and folded inwardly over itself along each of its side margins and then upperly over itself again into a compact rectangular form as illustrated in FIG. 3 overlying sidewall 12 of compartment 10. Flap 24 covers the folded sidewall 18 of compartment 16 as illustrated in FIG. 1 with peripheral edge 26 of the flap projecting beyond the folded sidewall.

A zipper 30 is utilized to connect the peripheral edge of flap 24 to sidewall 12 of compartment 10 for enclosing the folded sidewall 18 of compartment 16, as shown in FIGS. 1 and 2. Zipper 30 has one gripper side 29 connected to flap 24 about its peripheral edge 26. The other gripper side 31 of zipper 30 is secured to sidewall 12 of compartment 10 at a peripherally spaced location from portion 22 where sidewall 18 of compartment 16 is connected to sidewall 12. A fastener 33 slidibly interconnects gripper sides 29 and 31 of the zipper. This arrangement allows sidewall 18 to be folded quite easily so that its outline, defined by its folded peripheral edge 28, will fit well within the boundary of zipper side 31.

Figure 7:
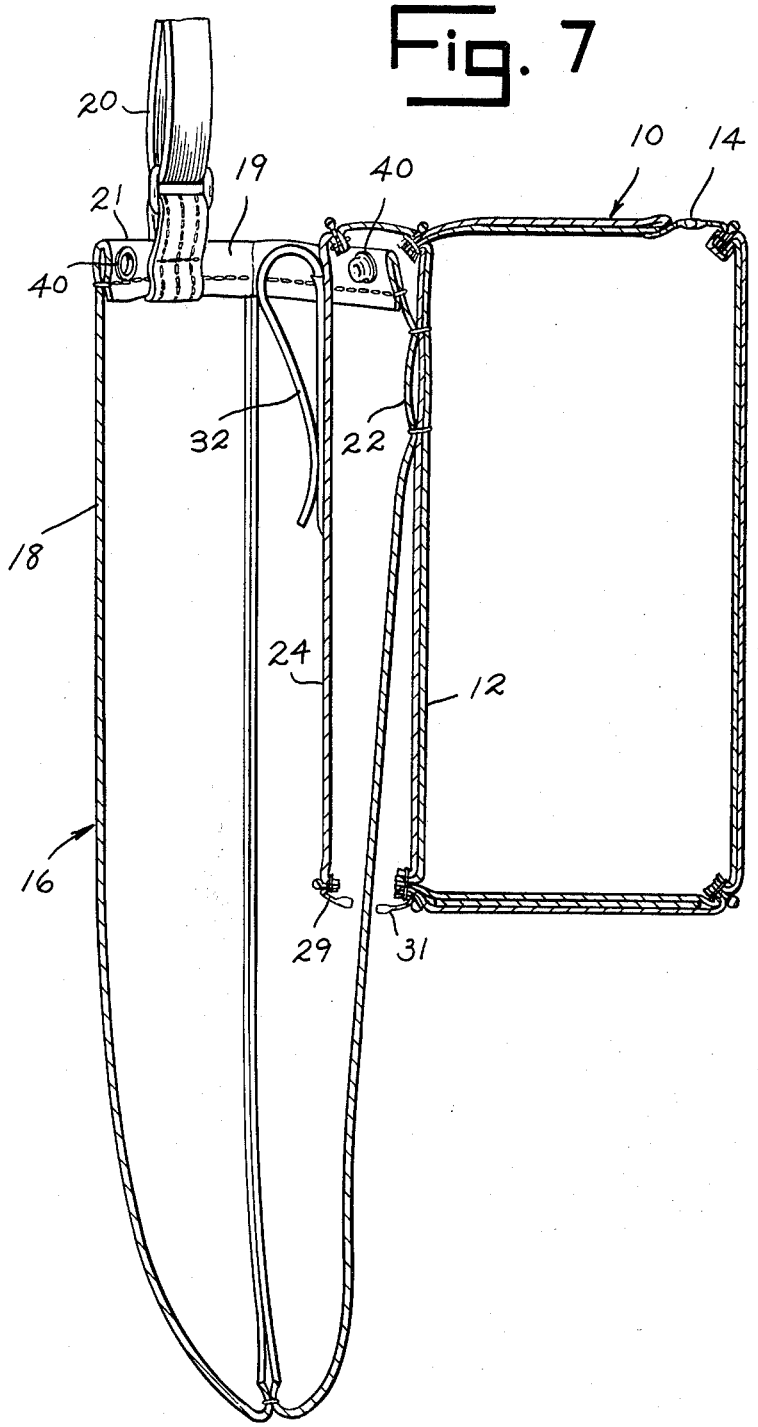
FIG. 7 is a cross sectional view of the carrying case taken along line 7—7 of FIG. 6.

Flap 24 carries a clip 32 which enables the carrying case to be carried upon the belt of the user when compartment 16 is in its stored position. If desired, a hand strap or similar carrying member may be connected to compartment 10 or flap 29 and used with or in place of clip 32. With compartment 16 in its stored position, compartment 10 may be utilized for carrying purse items, camera equipment, or similar articles. When it is desired to utilize compartment 16, zipper 30 is unzipped allowing flap 24 to be lifted and sidewall 18 of the compartment to be unfolded as illustrated sequentially first in FIG. 4 by arrow 34 and then in FIG. 5 by arrows 36. Strap 20 is then pulled from opening 19 into compartment 16 and flap 24 folded downwardly through the opening into compartment 16, as best shown in FIG. 7. In this manner, compartment 16 now may be utilized as a shopping or carrying bag. During the utilization of compartment 16, compartment 10 may be continued to be utilized for its original purpose. Snaps 40 may be applied along the upper edge of sidewall 18 of compartment 16 at opening 19 to enable the opening to be closed if desired.

When it is desired to store compartment 16, the user of the carrying case withdraws flap 24 and reinserts strap 20 into the compartment. Sidewall 18 compartment is then flattened or folded by following in reverse order the steps used to open the compartment. With compartment 16 having its sidewall 18 folded as seen in FIG. 3, flap 24 may then be positioned over the folded sidewall and secured to the underlying sidewall 12 of compartment 10 by zipper 30. By having compartment 16 secured to sidewall 12 of compartment 10 at portion 22 only of its sidewall 18 and at a location sufficiently spaced from where zipper side 31 is secured to compartment sidewall 12, compartment sidewall 18 may be folded upon itself compactly and in a simplified manner leaving sufficient space between the peripheral edge 28 of the folded sidewall and zipper 30 to allow flap 24 to be secured to sidewall 12 over the folded sidewall in an uncomplicated, non-interferring manner.

The carrying case of this invention may be constructed from a variety of materials such as leather or vinyl which may be lined if desired. Compartment 10, for ease of usability, is preferably of a flexible shape retaining configuration while compartment 16 is designed so as to be of a flexible, generally non-shape retaining configuration for ease of foldability.

It is to be understood that the invention is not to be limited to the details above given but may be modified within the scope of the appended claims.

What I claim is:

1. In a carrying case having a first compartment defined by sidewall, an access opening into said first compartment, a second compartment having foldable sidewall means for expanding and collapsing said second compartment between usable and stored positions, said second compartment carried by said first compartment and having an access opening therein, the improvement comprising means securing said second compartment at a part of its sidewall means to the sidewall of said first compartment for enabling said second compartment sidewall means to be folded against said first compartment sidewall to locate said second compartment in its stored position, a closure flap means anchored to said first compartment and having a marginal edge portion, said flap means for overlying said second compartment when in its stored position with said edge portion extending peripherally beyond said second compartment folded sidewall means, means carried by said flap means for releasably securing said flap means to said first compartment sidewall over said second compartment when in its stored position, said means for securing said second compartment to said first compartment being spaced from said means for releasably securing said flap means to said first compartment wherein said second compartment sidewall can be folded at a location spaced from where said flap means is releasably secured to said first compartment sidewall.

2. The carrying case in claim 1 wherein said flap means is anchored to said first compartment in all positions of said second compartment adjacently above said second compartment access opening, said flap means for fitting into said access opening of the second compartment when said second compartment is in its usable position.

3. The carrying case of claim 2 wherein said means for securing said flap means to said first compartment constitutes a zipper having two sides, one side of said zipper carried peripherally by said flap member, the other side of said zipper carried by said first compartment sidewall, means engaging both zipper sides for causing said two sides of interlock and enclose said second compartment in its stored position, said other zipper side carried by said first compartment being spaced from said means for securing said second compartment to said first compartment.

* * * * *